US011246357B2

(12) United States Patent
DiLorenzo et al.

(10) Patent No.: US 11,246,357 B2
(45) Date of Patent: Feb. 15, 2022

(54) SWIMSUIT WITH TENSION BANDS AND REINFORCEMENT LINERS

(71) Applicant: TYR Sport, Inc., Farmingdale, NY (US)

(72) Inventors: Matthew Vito DiLorenzo, New York, NY (US); Joseph DiLorenzo, Laurel Hollow, NY (US); Jared Berger, Farmingdale, NY (US)

(73) Assignee: TYR Sport, Inc., Farmingdale, NY (US)

( * ) Notice: Subject to any disclaimer, the term of this patent is extended or adjusted under 35 U.S.C. 154(b) by 0 days.

(21) Appl. No.: 17/347,229

(22) Filed: Jun. 14, 2021

(65) Prior Publication Data

US 2021/0360986 A1 Nov. 25, 2021

Related U.S. Application Data

(63) Continuation of application No. 17/133,060, filed on Dec. 23, 2020, now Pat. No. 11,058,157, which is a continuation of application No. 16/880,885, filed on May 21, 2020, now Pat. No. 10,905,175.

(51) Int. Cl.
*A41D 7/00* (2006.01)
*A41D 27/02* (2006.01)

(52) U.S. Cl.
CPC ..... *A41D 7/00* (2013.01); *A41D 27/02* (2013.01); *A41D 2400/24* (2013.01); *A41D 2400/82* (2013.01); *A41D 2600/10* (2013.01)

(58) Field of Classification Search
CPC ..... A41D 7/005; A41D 2600/10; A41D 1/08; A41D 13/012; A41D 13/00; A41D 37/02; A41D 2400/24; A41D 2400/82
USPC ..... 2/67, 69, 79, 227
See application file for complete search history.

(56) References Cited

U.S. PATENT DOCUMENTS 4,698,847 A * 10/1987 Yoshihara ..... A41C 1/06 2/69
5,699,559 A * 12/1997 Sano ..... A41B 9/08 2/67
5,819,322 A * 10/1998 Dicker ..... A63B 21/4017 2/456
5,857,947 A * 1/1999 Dicker ..... A63B 21/4019 482/124
6,231,488 B1 * 5/2001 Dicker ..... A63B 21/0552 482/124
7,546,751 B2 * 6/2009 Lutz ..... D04B 1/18 66/177
9,144,252 B1 * 9/2015 Kostrzewski ..... A41D 31/18
(Continued)

*Primary Examiner* — Gloria M Hale
(74) *Attorney, Agent, or Firm* — Stetina Brunda Garred and Brucker

(57) ABSTRACT

A swimsuit for competition swimming is contemplated as being formed with a network of tension bands disposed interior to the external surface of the swimsuit for storing energy and resisting motion, and with a plurality of reinforcement liners configured to complement the functionality of the network of tension bands while maintaining strength and flexibility in targeted locations while prevent intrusion of water from being retained within the components of the suit through a network of strategically positioned drains. The swimsuit may optimize the swimmer's swimming motion with reduced discomfort and without degrading prematurely due to wear.

20 Claims, 6 Drawing Sheets

(56) References Cited

U.S. PATENT DOCUMENTS

| | | | | |
|---|---|---|---|---|
| 9,895,569 | B2 * | 2/2018 | Yao | A63B 21/002 |
| 10,426,649 | B2 * | 10/2019 | Lyu | A41B 9/08 |
| 10,897,936 | B2 * | 1/2021 | Berger | A41D 7/00 |
| 10,905,175 | B1 * | 2/2021 | DiLorenzo | A41D 31/185 |
| 2004/0255358 | A1 * | 12/2004 | Ota | A41D 31/18 2/69 |
| 2008/0141430 | A1 * | 6/2008 | Rance | A41D 7/00 2/67 |
| 2008/0256675 | A1 * | 10/2008 | Di Lorenzo | A41D 7/00 2/67 |
| 2011/0214216 | A1 * | 9/2011 | Zarabi | A41D 1/00 2/69 |
| 2012/0150085 | A1 * | 6/2012 | Kayser | A61F 5/026 602/19 |
| 2013/0113806 | A1 * | 5/2013 | Naveh | G09G 5/246 345/467 |
| 2015/0208734 | A1 * | 7/2015 | Callahan | A41D 27/02 450/30 |
| 2015/0208934 | A1 * | 7/2015 | Sztrubel | A61B 5/4893 600/547 |
| 2016/0040325 | A1 * | 2/2016 | Hussey | A41D 13/012 139/422 |
| 2016/0113806 | A1 * | 4/2016 | Lyu | A41B 9/005 450/96 |
| 2017/0079339 | A1 * | 3/2017 | Yeomans | A41D 27/06 |
| 2017/0280791 | A1 * | 10/2017 | Spenser | A41D 13/012 |
| 2019/0045855 | A1 * | 2/2019 | Musciacchio | A41D 13/012 |
| 2019/0059465 | A1 * | 2/2019 | Zimmer | A41D 27/02 |
| 2019/0109531 | A1 * | 4/2019 | Zhao | H02M 1/38 |
| 2020/0107590 | A1 * | 4/2020 | Berger | A41D 7/005 |

* cited by examiner

SWIMSUIT WITH TENSION BANDS AND REINFORCEMENT LINERS

CROSS-REFERENCE TO RELATED APPLICATIONS

The present application is a continuation of U.S. patent application Ser. No. 17/133,060, filed Dec. 23, 2020, now U.S. Pat. No. 11,058,157, issued Jul. 13, 2021, which is a continuation of U.S. patent application Ser. No. 16/155,148, filed May 21, 2020, now U.S. Pat. No. 10,905,175, issued Feb. 2, 2021, the entire disclosure of which is expressly incorporated herein by reference.

STATEMENT RE: FEDERALLY SPONSORED RESEARCH/DEVELOPMENT

Not Applicable

BACKGROUND

1. Technical Field

The present disclosure relates generally to the field of sports garments. More particularly, the present disclosure relates to swimsuits or swim garments for water sports activities, especially competitive swimming.

2. Related Art

In the sport of competitive swimming, the ever-increasing levels of performance by elite athletes, aided by advances in nutrition, training, and especially swimsuit technology, has resulted in a continual rewriting of the record books. It is still of critical importance that elite competitors use the most effective and up-to-date swimsuit technology in order to optimize their performance within the rules and the competitive spirit of the sport. Today, no major Olympic or world record in men's or women's competitive swimming has stood unbroken for more than a decade, and every year new records continue to be set and exceeded at a tremendous rate.

Because swimmers require the best swimsuit technology to perform at the highest level, and that as the boundaries of human performance continue to be pushed, technology must be developed to support those advances.

Therefore, there is a need in the art for improved swimsuits that improve upon and eliminate the deficiencies of prior swimsuits.

BRIEF SUMMARY

To solve these and other problems, a swimsuit is contemplated as having at least a torso portion and two thigh portions configured to be worn over and compress against at least a portion of the torso and the thighs of the swimmer, the swimsuit comprising an external surface, a plurality of tension bands disposed interior to the external surface of the swimsuit, each of the one or more tension bands being configured to have a tensile elasticity along its longitudinal axis greater than the tensile elasticity of the external surface, the plurality of tension bands comprising at least two upper torso bands extending downward from a respective underarm region of the swimsuit to an opposite lateral waist region of the swimsuit, the at least two upper torso bands intersecting at a front centerline of the torso portion so as to define an X pattern, and a plurality of reinforcement liners interior to the external surface, each of the plurality of reinforcement liners being defined by or more peripheral regions and one or more interior regions, wherein the plurality of reinforcement liners at least partially occupy at least at an upper reinforcement zone defined by the upper portion of the x pattern, a lower reinforcement zone defined by the lower portion of the x pattern, and two lateral reinforcement zones defined by the lateral side portions of the x pattern; and wherein the plurality of reinforcement liners at least partially occupy the upper reinforcement zone, the lower reinforcement zone, and the lateral reinforcement zones are detached from the external surface at their respective one or more interior regions.

The plurality of the tension bands may be disposed on the interior surface of the swimsuit. The external surface across the rear of the torso portion, the rear of the two thigh portions, and the junction therebetween may be formed from a continuous, seamless external surface material.

The upper torso bands may also further comprise additional rear waist portions which extend to a rear waist region of the swimsuit. The two upper torso bands may be joined at the rear waist portion. The upper torso bands may also each additional comprise a rear thigh portion which extends to a rear of a perineum region of the swimsuit.

The plurality of tension bands may also further comprises at least one of the group selected from: (a) a central rear band extending rearward from a perineum region of the swimsuit and vertically upward along the rear centerline of the torso portion; (b) a pair of lower torso bands, each of the lower torso bands extending laterally forward and upward from a perineum region of the swimsuit to at least a lateral region of the torso portion; (c) a pair of rear torso bands, each rear torso band extending upward along the rear of a respective buttock region of the torso portion to a rear of the waist region of the torso portion; (d) an inner thigh band extending upward along an inner thigh region of one thigh portion, across the perineum region, and downward along the inner thigh region of the other thigh portion; (e) a pair of side thigh bands, each side thigh band extending laterally rearward from the perineum region, around the side of a respective thigh portion, and to the front of a respective thigh portion; (f) a pair of front thigh bands, each front thigh band extending upward along the front of a respective one of the thigh portions; and (g) a rear waist band, the rear waist band being positioned laterally along the rear waist region of the swimsuit.

In embodiments in which the plurality of tension bands comprises the pair of lower torso bands, and each lower torso band may further extends upward around a respective lateral side of the torso portion to a rear of the torso portion.

In embodiments in which the plurality of tension bands comprises the pair of rear torso bands, each rear torso band may further extend beyond the rear of the waist region of the torso portion.

The reinforcement liner at least partially occupying at least at the upper reinforcement zone may defines at least one drain region wherein a portion of the peripheral region is detached from the external surface of the swimsuit. The reinforcement liner at least partially occupying at least at the lower reinforcement zone may also defines at least one drain region wherein a portion of the peripheral region is detached from the external surface of the swimsuit.

In embodiments in which the plurality of tension bands further comprises at least the pair of rear torso bands, the pair of side thigh bands, and the pair of front thigh bands, each respective rear torso band, side thigh band, and front thigh band of each pair may defines a respective outer thigh reinforcement zone, with each outer thigh reinforcement zone being at least partially occupied by a reinforcement liner. The reinforcement liner at least partially occupying at least at the outer thigh reinforcement zone may also defines at least one drain region wherein a portion of the peripheral region is detached from the external surface of the swimsuit.

In embodiments in which the two upper torso bands further extend to and are joined at a rear waist region of the swimsuit, and wherein the plurality of tension bands further comprises at least the pair of rear torso bands, the pair of side thigh bands, the inner thigh band, and the central rear band, each respective rear torso band and side thigh band of each pair together with the inner thigh band, the central rear band and the extended portion of the two upper torso bands joined at the rear waist region of the swimsuit may defines a respective buttock reinforcement zone, with each buttock reinforcement zone being at least partially occupied by a reinforcement liner. The reinforcement liner at least partially occupying at least at the buttock reinforcement zone may also defines at least one drain region wherein a portion of the peripheral region is detached from the external surface of the swimsuit.

In embodiments in which the plurality of tension bands further comprises at least the pair of rear torso bands, the pair of lower torso bands, and the pair of side thigh bands, each respective rear torso band, lower torso band, and side thigh band together with a respective upper torso band may defines a respective side waist reinforcement zone, with each side waist reinforcement zone is at least partially occupied by a reinforcement liner. The reinforcement liner at least partially occupying at least at the side waist reinforcement zone may also defines at least one drain region wherein a portion of the peripheral region is detached from the external surface of the swimsuit.

Each thigh portion of the swimsuit may also be provided with an annular leg band, which according to certain embodiments may be configured to cause the swimsuit to apply a localized compressive force to the thighs of the swimmer greater that that the compressive force applied by the external surface of the swimsuit at the thigh portion alone, or which configured to grip the thighs of the swimmer more securely than the external surface of the swimsuit at the thigh portion alone. The annular leg bands may be configured to grip the thighs of the swimmer more securely than the external surface of the swimsuit via being formulated from a material having a lower coefficient of friction when wet than the material of the external surface.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

According to various aspects of the present disclosure, new and improved swimsuits are contemplated as having an external surface with various systems of tension bands and reinforcement liners disposed interior to the external surface which serve to optimally position the swimmer's body during swimming by resisting motion to a suboptimal swimming position, to optimize the storage and release of energy during the swimmer's motions, to optimize the characteristics of flexibility, strength, and comfort at different locations in the swimsuit, to optimize the prevention of intrusion of water into the area between the swimsuit and the body of the swimmer, and to optimize the capability of the swimsuit to permit such water intrusions to be rapidly and comfortably evacuated during the normal motions of swimming.

Figures 1, 2, 3:
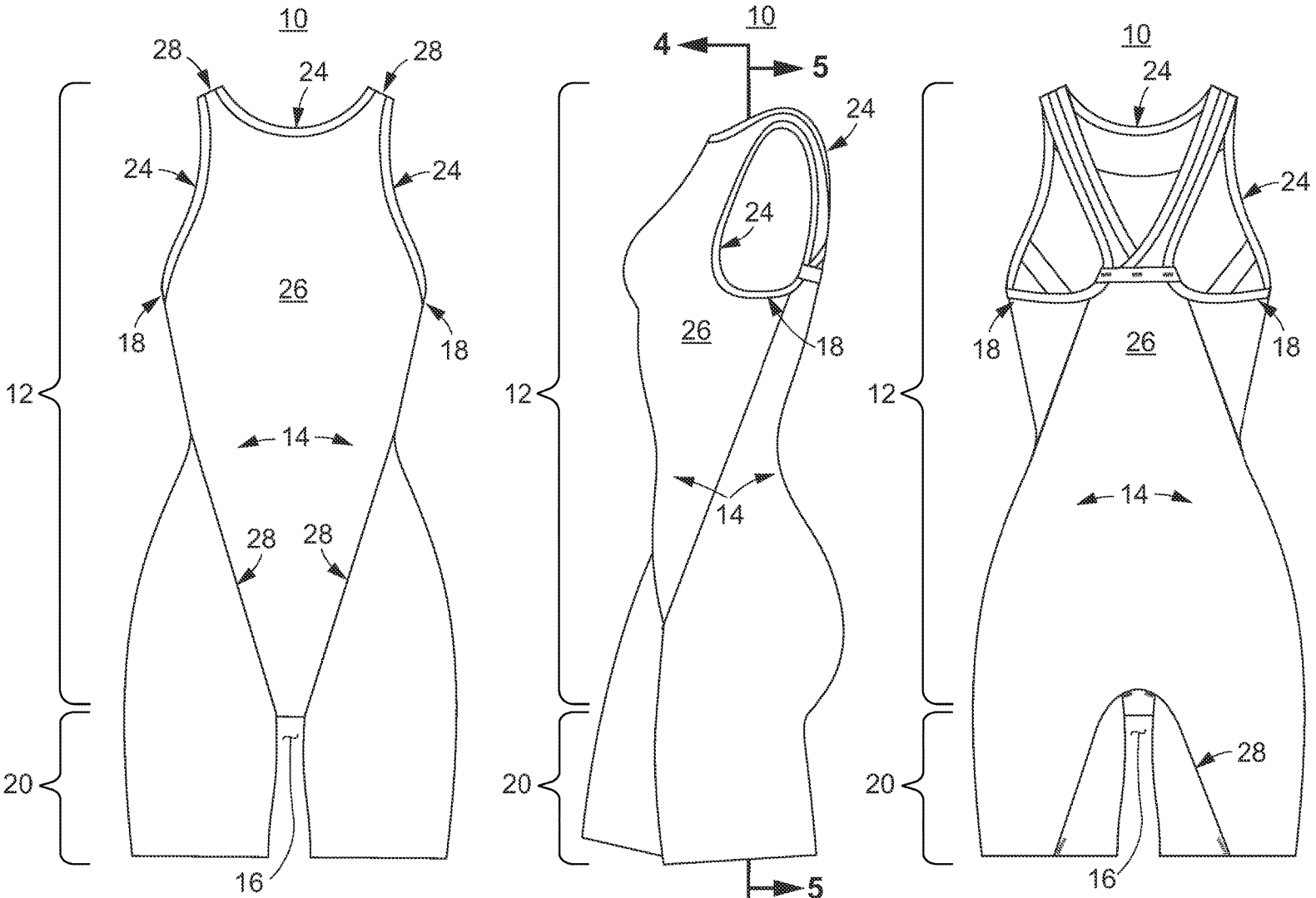
FIG. 1 is a front view illustrating the external surface of a swimsuit according to an exemplary embodiment of the present disclosure.
FIG. 2 is a side view illustrating the external surface of a swimsuit according to a first exemplary embodiment of the present disclosure.
FIG. 3 is a rear view illustrating the external surface of a swimsuit according to a first exemplary embodiment of the present disclosure.

Turning now to FIG. 1, a front view of an exemplary embodiment of a swimsuit 10 of the present disclosure is shown, the illustrated embodiment having a racerback-style configuration typically worn by female competitive swimmers. As may be seen in the illustration of this exemplary embodiment, such a swimsuit 10 may have a torso portion 12 generally configured to be worn over and compress against the swimmer's torso. For purposes of this disclosure, in order to maintain consistent terminology between different configurations of embodiments, the torso portion 12 is to be understood as the portion of the swimsuit including a waist region 14 of the swimsuit 10 configured to be worn at the waist of the swimmer, a perineum region 16 of the swimsuit configured to be worn between the legs of the swimmer at the base of the groin, and all areas of the swimsuit vertically above the perineum region 16 as would be worn upon a swimmer in a standing position, which is the orientation shown in FIG. 1 and all other figures. It may be seen that the torso portion 12 may be configured differently in accordance with the style of swimsuit, for example, the women's razorback style embodiment shown and illustrated in FIG. 1, as well as bodysuit-style swimsuits for any gender. In the exemplary razorback style embodiment shown in FIG. 1, the torso portion extends to at least the shoulder of the swimmer, and has an underarm region 18 in the area of the lower hemisphere of the aperture in in the illustrated swimsuit where the arms of the swimmer would protrude. In other embodiment, however, which may include swimsuit elements covering the swimmer's arms instead of apertures for arms, it may be seen that the underarm region 18 would be positioned at about the same location.

The swimsuit 10 may also have two thigh portions 20 configured to be worn over and compress against at least part of each of the swimmer's thighs. In the exemplary embodiment of FIG. 1, it may be seen that each thigh portion 20 extends over at least the upper thighs of the swimmer, but terminates above the knee. It may also be seen, however, that according to other embodiments, the thigh portions 20 may be very short, while in other embodiments, the thigh portions may be extended, perhaps to above or below the knee or further, such as to the ankle, or even to fully enclose a swimmer's feet. For purposes of this disclosure, the thigh portions 20 shall be understood as comprising all areas of the swimsuit vertically below the perineum region 16 as would be worn upon a swimmer in a standing position and as shown in the figures. Optionally, in certain embodiments, the thigh portions 20 may include at their base or at other portions an annular or partially annular leg band 22 for applying a localized compressive force greater than the compressive force applied by the external surface 26 at the thigh portions alone and/or being formed of a gripping or water-resistant material, in order to reduce the chance of a thigh portion 20 moving out of position on the swimmer and bunching or creasing, and to prevent the intrusion of water into the area between the swimsuit and the body of the swimmer, either of which would reduce the swimmer's performance by altering the hydrodynamic profile of the swimmer, discomforting the swimmer, requiring the swimmer to carry additional mass, or would reduce the swimmer's performance otherwise. In particular, it may be seen that it may be desirable to form the annular leg bands 22 of a material having a lower coefficient of friction when wet than the material of the external surface 26, in order to enable the leg bands to grip the legs of the swimmer more securely while worn in the water, while it may also be desirable for the material of the annular leg bands 22 to have an equal coefficient of friction to the prevailing material of the external surface 26 when dry. In this way, it may be seen that the act of donning the swimsuit 10 while the wearer and the swimsuit 10 are dry may be more easily facilitated. In the exemplary embodiment, the annular leg bands 22 are formed of a grip material and positioned at least an internal side of a lower edge of a thigh portion 20. However, it may be seen that the in other embodiments, the annular leg bands 22 may be positioned at other locations, such as at intermediate portions of the thigh portion 20 rather than the lower edges, or outside or integrally formed with the external surface 26 of the swimsuit 10, which may be beneficial when the annular leg bands 22 do not necessarily operate via formed of a material configured to itself grip the swimmer but rather through additional compressive force alone, or that multiple annular leg bands 22 may be included for each thigh portion. It may also be seen that in embodiments such as those discussed above where the torso portion is additionally provided with swimsuit elements covering at least a portion of the swimmer's arms, annular arm bands of a similar configuration to the annular leg bands 22 may be included and may achieve a similar function. Furthermore, even in embodiments without swimsuit elements provided covering at least a portion of the swimmer's arms, it may be desirable to form areas at the periphery of the torso portion of the swimsuit of similar material or construction, such as the edges of the regions of the swimsuit where the swimmer's arms may be exposed or protrude, or where the swimmer's neck, head, shoulders, upper back, etc. may protrude. It may further be seen that in embodiments where the annular leg bands 22 are at the lower edge of an external surface 26 of the swimsuit 10, the annular leg bands 22 may additionally serve as a strengthening element for the swimsuit so as to add structural integrity, and further as an anchoring point for one or more of the tension bands discussed herein, such as the front and rear thigh tension bands, which may be achieved in a variety of ways. In the exemplary embodiments, for example, it may also be seen that one or more bartack stitches may be used in order to reinforce a junction at the annular leg band 22 where a seam 28 in the material of the external surface 26 exists or where one or more tension bands are positioned internal to the external surface 26, such as in an anchoring point.

It may further be seen that whether serving the role of the strengthening element or not, it may be desirable for the annular leg bands 22 or other bands which serve strengthening, waterproofing, or gripping roles for the swimsuit, when located at a position on the swimsuit where the swimmer's body transitions between covered and uncovered or less covered by the swimsuit, which may be an edge or even an internal or partially internal opening or reduction in material of the swimsuit, which may serve aesthetic purposes or functional purposes (i.e. material reduction or elimination in less necessary locations for lightening or comfort), the annular leg bands 22 or other bands of the swimsuit may be on the outside of the swimsuit or folded over an edge of an opening of the swimsuit so as to reside on both the external surface 26 of the swimsuit 10 and on the internal surface of the swimsuit 10. For example, in an embodiment such as that illustrated in FIG. 1, the area of the swimsuit configured for the swimmer's arms and neck to protrude are provided with a binding material 24 that is folded over the edge of such areas and reside both on the outside and inside of the swimsuit 10 at that location, while the annular leg bands 22 are not folded over the edge of the lower extremity of the thigh portion.

It is contemplated that a swimsuit 10 may have an external surface 26. The external surface 26 may be formed of any material suitable for use in a swimsuit, such as a fabric. In the exemplary embodiment, the external surface is a woven fabric formed of a blend of nylon and spandex. The external surface 26 may itself serve to compress against the swimmer, or there may be further inclusions in the swimsuit which apply compression, such as one or more layers under the external surface. The external surface may be formed of the same material across the entirety or majority of the swimsuit, or may be formed of different materials. In the exemplary embodiment illustrated in FIG. 1, the external surface 26 is formed of two continuous panels of material joined together via only a minimal amount of seams 28—a pair of seams 28, illustrated with a solid line, in a "v" configuration, with the bottom tip of the "v" located at the perineum region 16, a pair of shoulder seams at the upper region of the shoulder portion of the swimsuit 10 to join together the top of the swimsuit's shoulder straps to the front of the torso portion, the and an inner thigh seam more fully illustrated in FIG. 2. When viewed from the front, the "v" configuration of the pair of seams 28 with a "v" configuration is apparent, with each seam 28 traveling diagonally upwards towards a front side of the waist region 14, and proceeding around the side of the upper torso portion 22 towards the upper back region of the swimsuit, as more fully illustrated in FIGS. 2 and 3. However, it may be seen that in other embodiments, other configurations of seams may be utilized to joint together panels of material of the external surface 26.

Turning now to FIG. 2, a side view of the exemplary embodiment of the swimsuit 10 of FIG. 1 is shown. As may be seen, the two-panel construction of the exemplary swimsuit 10 with the "v" shaped torso seam 28 configuration is further shown. It may be seen how each of the torso seams 28 may continue up from the front of the waistband region 24 and around the side of the upper torso portion 22. As such, the entirety of the external surface 26 across the rear of the torso portion and the rear of the two thigh portions, and the previously defined junctions therebetween, is configured to be formed of an entirely continuous and seamless panel of material. This seamless, continuous construction of the external surface 26, which, in the illustrated exemplary razorback-style embodiment, also is continuous and seamless with other portions of the swimsuit 10, and serves to enhance the performance of the swimmer. By providing a seamless, continuous material across this area, it may be seen that the aerodynamic and hydrodynamic profile of the swimmer may be optimized, as there are no seams which would otherwise result unwanted drag, eddies, or other disruptions. Furthermore, the positioning of this continuous, seamless surface positioned in this area may serve to optimize the rapid dispersion of water away from the swimmer when the relevant portions of the swimsuit are above water, such as during freestyle events. Not only may the presence of seams result in diminished streamlining, but the presence of seams on the portions of the swimsuit that transition above and below the waterline may result in the carrying of additional quantities of water on the swimmer's body above the waterline that add to the swimmer's mass, reducing the swimmer's velocity through the water. Without seams on these portions of the swimsuit, water that is carried on the swimmer's body above the waterline will also tend to more rapidly flow off the swimmer without obstruction, resulting in a further optimization of the swimmer's performance. It may be seen that in the exemplary embodiment, such a seamless construction may continue to the rear thigh portions of the swimsuit which may be joined to the front of the thigh portions via a single seam 28 at an inner thigh region that extends up one inner thigh portion of the swimsuit, across the perineum region 16 of the swimsuit, and down the other inner thigh portion of swimsuit. For strengthening and/or anchoring purposes, further bartack stiches may be located at the perineum region.

Turning now to FIG. 3, a rear view of the embodiment of a swimsuit 10 illustrated in FIG. 1 is shown. As may be seen by FIG. 3, the external surface 26 at the rear of the torso portion 12, the rear of the two thigh portions 18, may be formed such that junction therebetween is formed from continuous, seamless external surface material. It may additionally be seen that according to this embodiment, an additional inner thigh seam 30 may be positioned at the inner thigh region 32 of the swimsuit to join together the material of the external surface 26 of the annular thigh portions 18, with the inner thigh seam 30 running up the inner thigh region 32 of one of the thigh portions 18, across the perineum region 16, and down the inner thigh region 32 of the other of the thigh portions 18. In this manner, it may be seen that because the majority of the inner thigh seam 30 will be positioned essentially axial with the direction of motion of the swimmer's body during swimming, and will be shielded by the swimmer's body from direct exposure to oncoming water during front-facing swimming strokes, such as the freestyle or breaststroke, the diminishment in hydrodynamic efficiency caused by the presence of this inner thigh seam 30 will be minimized.

Figure 5:
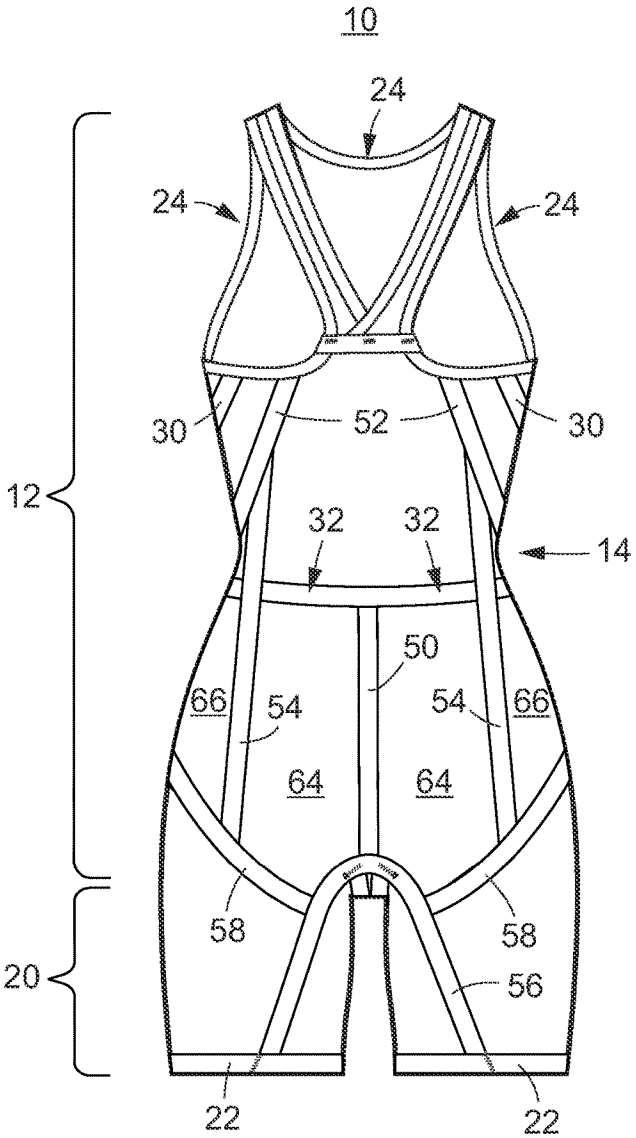
FIG. 5 is a rear internal view illustrating the arrangement of tension bands and reinforcement liners disposed interior to the external surface of a swimsuit according to a first exemplary embodiment of the present disclosure.
Figure 4:
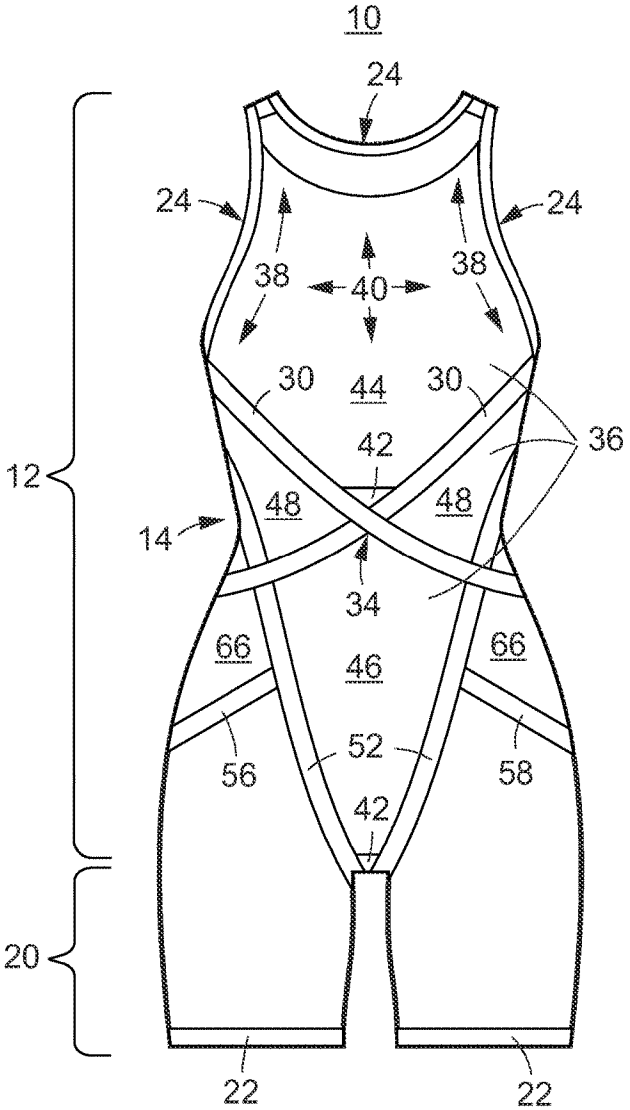
FIG. 4 is a front internal view illustrating the arrangement of tension bands and reinforcement liners disposed interior to the external surface of a swimsuit according a first exemplary embodiment of the present disclosure.

Turning now to FIGS. 4 and 5, front and rear internal views of a first embodiment of a plurality of tension bands and reinforcement liners disposed interior to the external surface as shown in FIGS. 1-3 is illustrated. As may be seen from FIGS. 4 and 5, groups of tension bands may be disposed interior to the external surface 26 of a swimsuit 10, with these tension bands serving to coordinate together to resist motion and to store energy during the motions of the swimmer during swimming, so as to maintain an optimal body position and to optimize the swimming mechanics of the swimmer. The tension bands may be visibly disposed on the interior surface of the swimsuit, or embedded within an interior side of the swimsuit, or may be disposed at an interior portion of the swimsuit between the external surface and an internal layer, or in other configurations. Each tension band may be configured to have a tensile elasticity along its longitudinal axis greater than the tensile elasticity of the external surface material, promoting a greater resistance to motion along the long axis of the tension bands in the swimmer, and a corresponding storing and release of energy during the swimmer's movement. Depending on the degree of tensile elasticity of the tension bands and other configuration changes, it is also contemplated that embodiments of the herein disclosed swimsuits may also be configured to make the swimmer's swimming motion substantially more difficult, which may be desirable in a training swimsuit for improving a swimmer's strength and range of motion. The tension bands may be attached to the remainder of the swimsuit 10 over their entire length, or they may be attached only at selected points, depending on the particular requirements of the swimsuit or the configuration of tension bands, from which various advantages may flow.

In the embodiment illustrated in FIGS. 4-5, a number of groups of tension bands are illustrated. It may be seen in different embodiments of a swimsuit 10 according to the present disclosure, however, that different combinations of some or all of these groups of tension bands, or further additional tension bands may be utilized. For example, while the first embodiment illustrated in FIGS. 4-5 may include certain particular groups of tension bands, the inclusion of all or even most groups is not necessary, and embodiments are contemplated which include certain but not all of the herein discussed of the groups of tension bands, in various combinations, may be utilized, or that other embodiments, such as those illustrated in FIGS. 6-7, may utilize additional groups of tension bands.

A first contemplated group of tension bands may comprise a pair of upper torso bands 30, each upper torso band 30 being configured to extend downward from a respective underarm region 18 of the swimsuit 10 to an opposite lateral side of the waist region 14, with the upper torso bands 30 intersecting at a front centerline of the torso portion 12 so as to define an X pattern 34. Optionally, certain embodiments such as the first embodiment pictured in FIGS. 4-5 may be configured such that the two upper torso bands further comprise rear waist portions 32 which extend to a rear of a waist region 14 of the swimsuit. As may be seen by the illustrated embodiment of FIGS. 4-5, the rear waist portions 32 may even be joined together.

As may also be seen, a plurality of reinforcement liners 36 may be disposed interior to the external surface 26 of the swimsuit 10. Each reinforcement liner 36 may be defined by one or more peripheral regions 38 generally located at the periphery of the reinforcement liner 36, and one or more interior regions 40 generally located at the interior of the reinforcement liner 36. Each reinforcement liner 36 may be detached from the external surface 26 of the swimsuit 10 at the interior regions 40, which may be seen to enhance the overall flexibility of the swimsuit 10 and increase the comfort of the wearer by permitting an amount of transverse "sliding" movement of the external surface 26 of the swimsuit relative to the interior regions 40 of the reinforcement liners 36, which may in certain embodiments be desired to have a tendency to remain in place against body of the wearer and to resist transverse displacement. In this fashion, the optimized action of the swimsuit facilitated primarily by the action of the tension bands during swimming may serve to optimize the swimming motion, posture, and energy usage of the swimmer and permit an optimized range of motion of the external surface 26 of the swimsuit 10, without necessarily requiring that complete range of motion to fully frictionally transmit to the wearer's body, which may cause discomfort to the wearer. Rather, it may be seen that by placing the reinforcement liner 36 in strategic locations against the external surface 26 as primarily dictated by the specific configuration of the tension bands used, the forces stored and released in the tension bands are more likely to be directly utilized as part of the wearer's swimming motion and not lost due to frictional causes or otherwise become a perceptible distraction by the wearer.

Generally, it may be seen that the motion of the external surface 26 due to the configuration of the swimsuit during swimming will usually result in a sliding action, and that it is preferable that it is one objective of this disclosure that the frictional result of such sliding action will preferably result in the portions of the external surface 26 prone or configured to engage in such sliding action (primarily dictated by the configuration of the tension bands) will be directed against the reinforcement liner rather than the wearer's skin. It may thus be seen that not only will this result in reduce discomfort and reduced heat buildup, but this may also result in a more efficient suit, as the frictional engagement between the external surface 26 and the reinforcement liner 36 may be, as a result of the material chosen for each component in each specific location, configured to have more or less resistance to motion (as desired in any particular location) than that of the material of the external surface 26 against a wearer's bare skin or other garments worn underneath the swimsuit 10. Furthermore, the reinforcement liner may also serve to reinforce regions of the external surface 26 prone to wearing out or failing, which may server prolong the life of the suit and to prevent damage due to use, such as rips or tears, and to preserve the ability of the swimsuit 10 to deliver an optimized swimming performance.

While the reinforcement liner 36 may be detached from the external surface 26 of the swimsuit 10 at its interior regions 40, it may be attached to the external surface 26 at its peripheral regions 38, either directly or through an intermediate, such as the upper tension bands 30. Such attachment may be made in any method of attachment known to be useful in the art of swimsuit fabrication, such as sewing or adhesive bonding, so as to maintain the integrity and strength of the swimsuit 10.

One important aspect of the interrelationship between the reinforcement liners 36 and the external surface 26 is the optional presence of one or more drain regions 42 which may comprise an area of the reinforcement liner 36 that is detached from the external surface 26 of the swimsuit so as to permit water which may have intruded between the reinforcement liner 36 and the external surface 26 to rapidly be removed from the space between the two. In the first embodiment shown in FIGS. 4-5, the drain regions 42 comprise small areas at a periphery of the reinforcement liner 36 that is open to the area between the reinforcement liner 36 and the external surface 26, with those areas generally being at the lowermost portion of the reinforcement liner 36. By positioning the drain region 42 at the lowermost portion, it may be seen that intrusions of water may be seen to most rapidly be evacuated due to the action of gravity when the swimmer is in an upright position, and may be readily evacuated by the swimming action of the swimmer when the swimmer is moving in a head-first direction as when swimming in a freestyle motion due to the action of water flowing over the surface of the suit frictionally transmitting force to water trapped between the reinforcement liner 36 and the external surface 26 and encouraging motion in the opposition direction of the wearer's travel through the water. However, it may also be seen that the drain region 42 may be positioned at other locations for optimal performance in other embodiments of swimsuits 10 optimized for other types of competitions, such as other forms of swimming strokes which may result in different engagement of muscle groups and result in a different general pattern of fluid flow for fluids intruding between reinforcement liner 36 and the external surface 26 due to the action of the wearer's body against those regions. It is generally an objective of the drain region 42 to promote removal of intruded water as rapidly as possible, and to prevent the intrusion of water, and as such, the location and configuration of the drain region 42 may be guided by these objectives and further guided by the configuration of the tension bands.

It may be seen that the X pattern 34 formed by the intersection of the upper torso bands 30 may define an upper reinforcement zone 44 above the X, a lower reinforcement zone 46 below the X, and a pair of lateral reinforcement zones 48 on the sizes of the X. Each of these zones may be at least partially occupied by one or more reinforcement liners in the manner as discussed in the preceding paragraphs. As the core chest muscles are one of the principal muscle groups utilized by swimmers in most competitive events, these regions of the swimsuit 10, through the action of the upper torso bands 30, represent an area which is prone to motion and wear during use of the swimsuit. As such, the distinct positioning of one or more reinforcement liners 36 in each of these zones as described above, each optionally with one or more drain regions 42, represents an important improvement that serves to provide and enable the functionality of a more optimized swimsuit both in terms of direct performance and in terms of user comfort, which may frequently be seen to have an indirect effect on performance as well.

Figure 7:
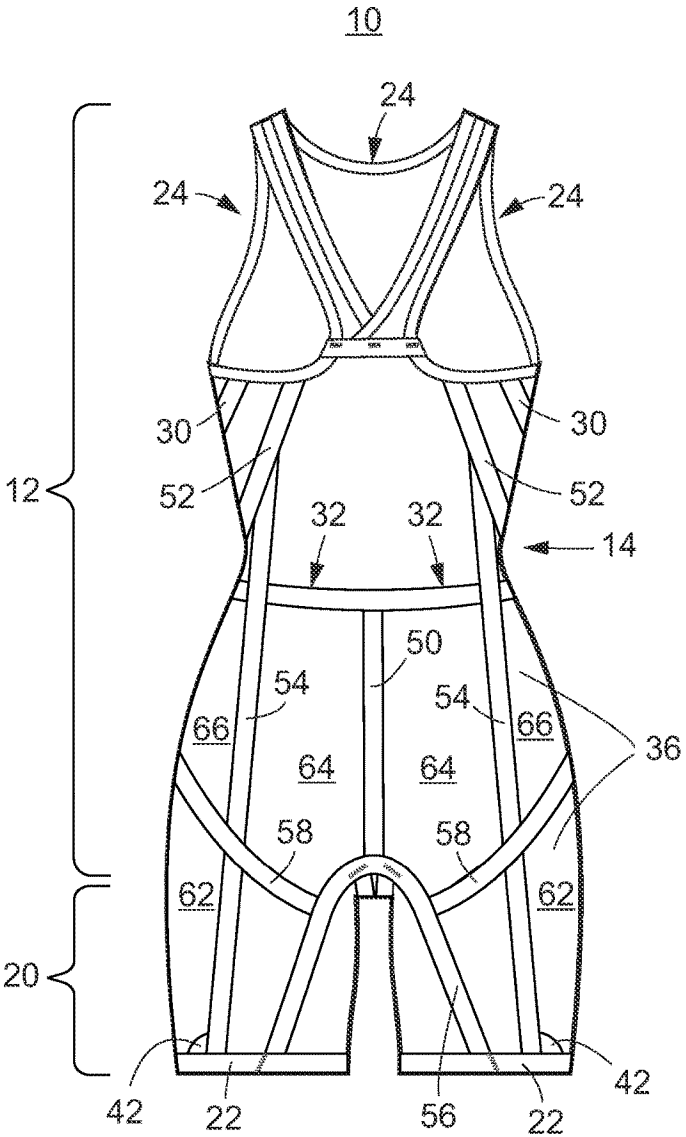
FIG. 7 is a rear internal view illustrating the arrangement of tension bands and reinforcement liners disposed interior to the external surface of a swimsuit according a second exemplary embodiment of the present disclosure.
Figure 6:
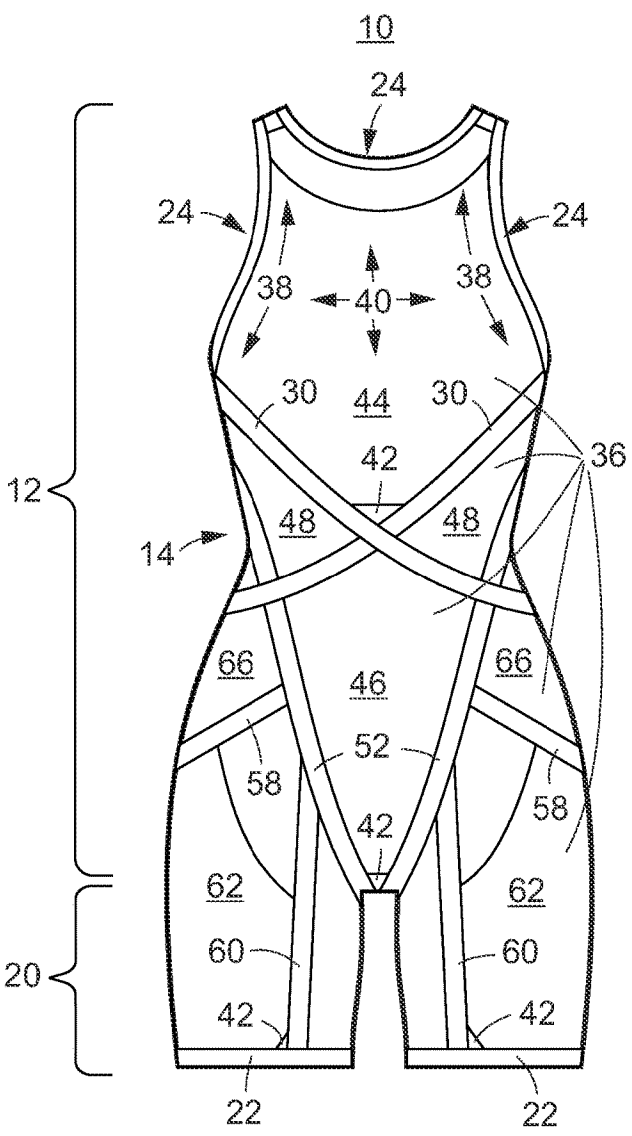
FIG. 6 is a front internal view illustrating the arrangement of tension bands and reinforcement liners disposed interior to the external surface of a swimsuit according to a second exemplary embodiment of the present disclosure.
Figure 9:
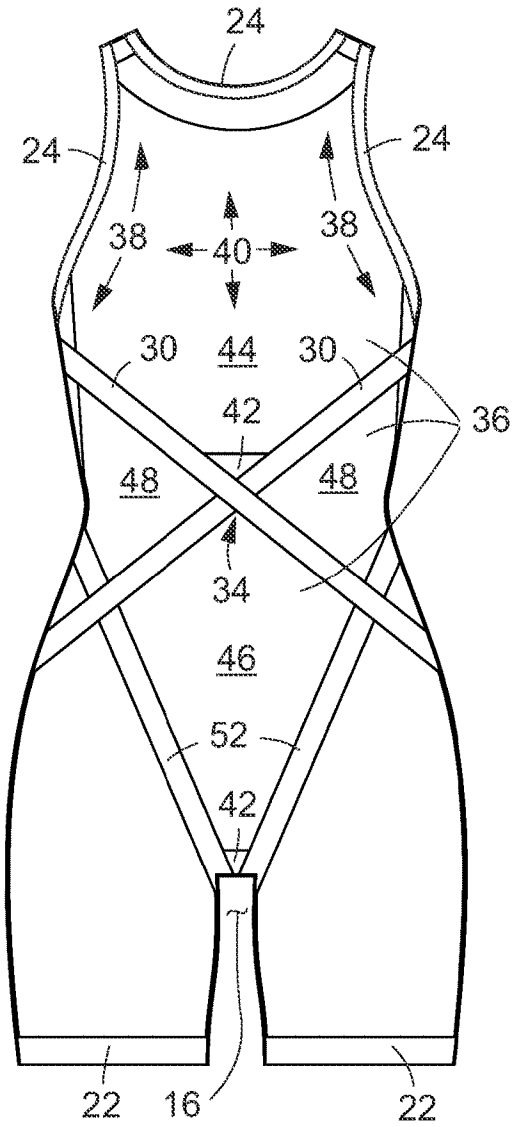
FIG. 9 is a front internal view illustrating the arrangement of tension bands and reinforcement liners disposed interior to the external surface of a swimsuit according a third exemplary embodiment of the present disclosure.
Figure 8:
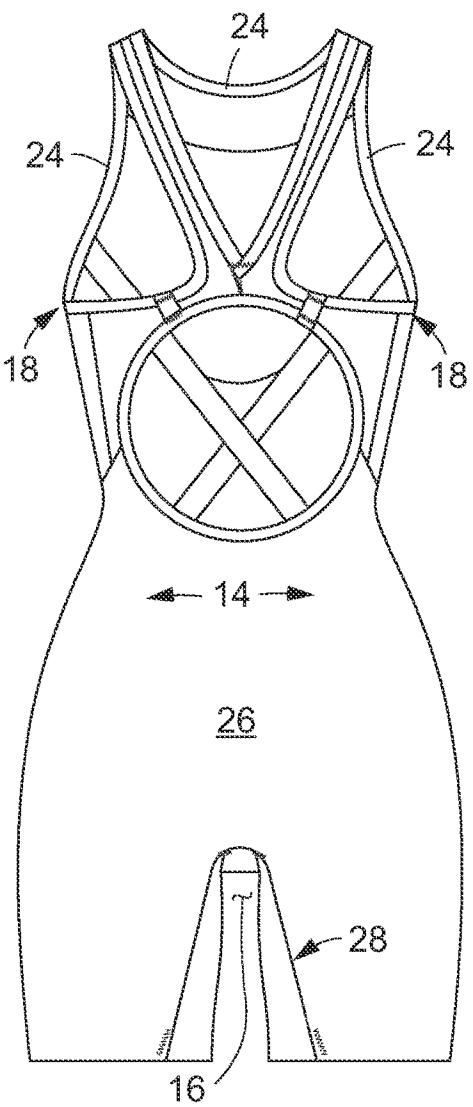
FIG. 8 is a rear view illustrating the external surface of a swimsuit according to a third exemplary embodiment of the present disclosure.
Figure 11:
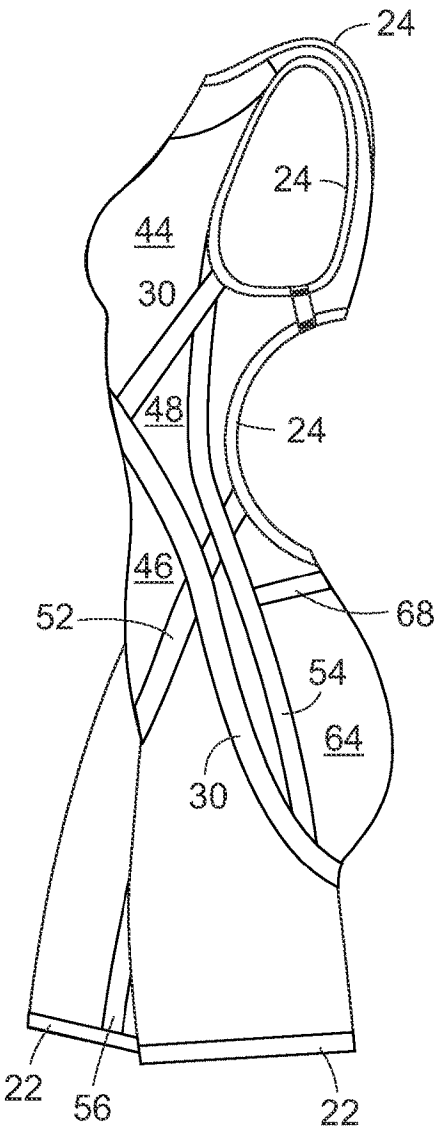
FIG. 11 is a side internal view illustrating the arrangement of tension bands and reinforcement liners disposed interior to the surface of a swimsuit according a third exemplary embodiment of the present disclosure.
Figure 10:
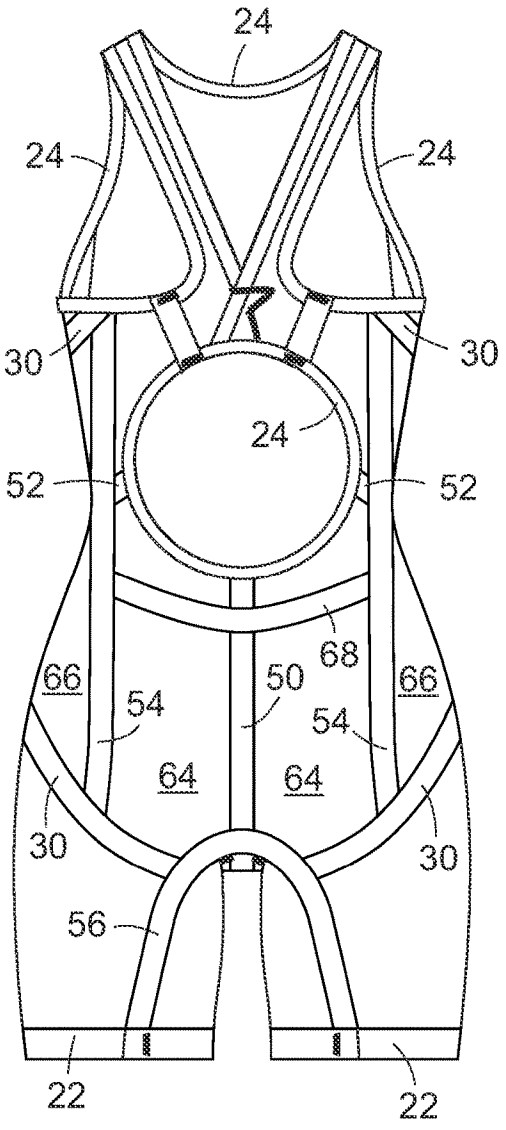
FIG. 10 is a rear internal view illustrating the arrangement of tension bands and reinforcement liners disposed interior to the external surface of a swimsuit according a third exemplary embodiment of the present disclosure.
Figure 14:
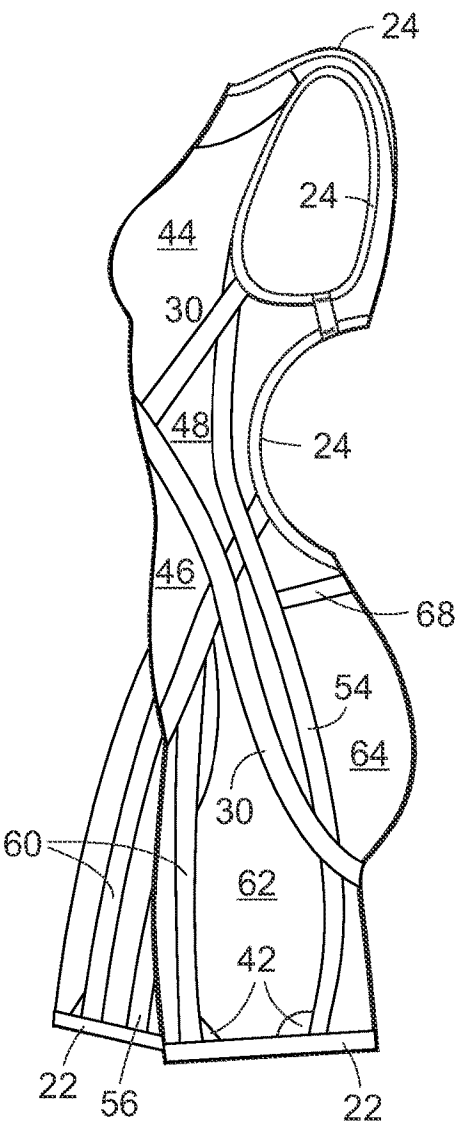
FIG. 14 is a side internal view illustrating the arrangement of tension bands and reinforcement liners disposed interior to the surface of a swimsuit according a fourth exemplary embodiment of the present disclosure.
Figure 13:
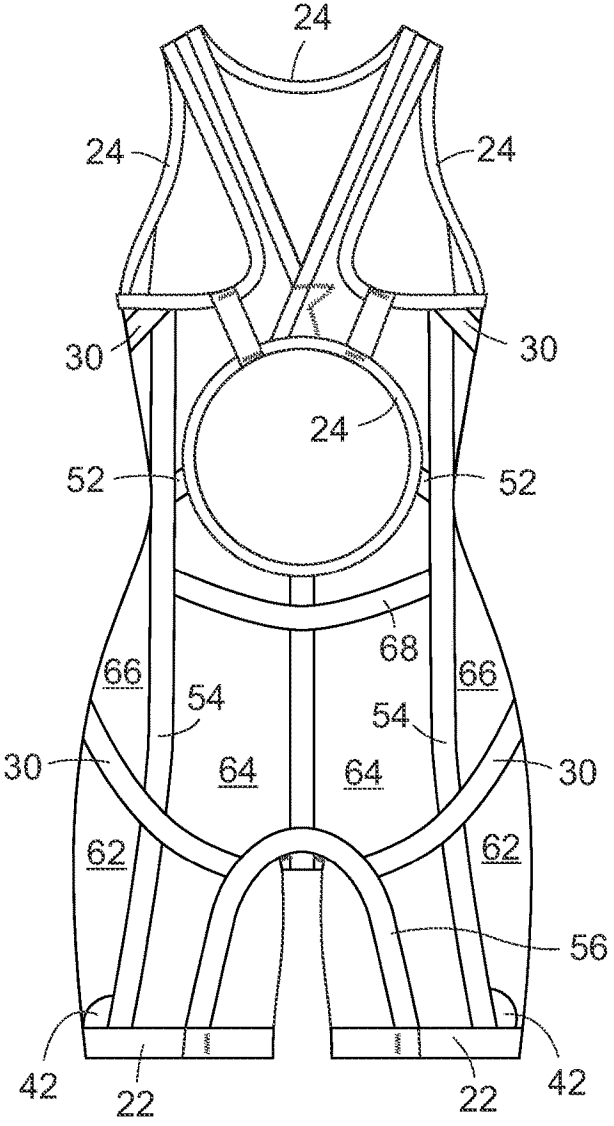
FIG. 13 is a rear internal view illustrating the arrangement of tension bands and reinforcement liners disposed interior to the external surface of a swimsuit according a fourth exemplary embodiment of the present disclosure.
Figure 12:
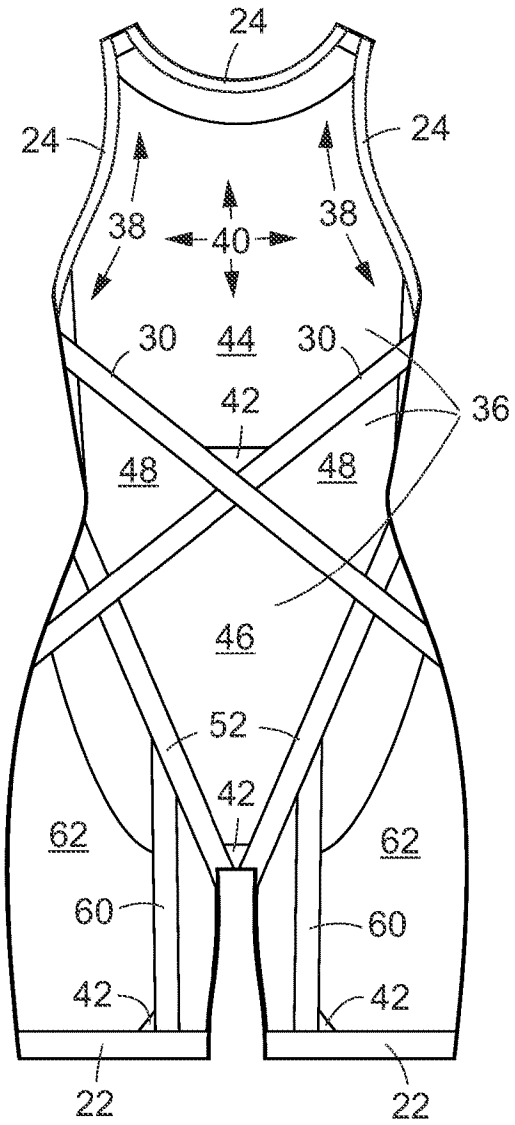
FIG. 12 is a front internal view illustrating the arrangement of tension bands and reinforcement liners disposed interior to the external surface of a swimsuit according a fourth exemplary embodiment of the present disclosure.

Returning now to the discussion of the tension bands, FIGS. 4-7 are illustrative, with FIGS. 4-5 showing a first illustrative embodiment of a contemplated network of tension bands, and FIGS. 6-7 showing a second illustrative embodiment of another contemplated network of tension bands. It may be seen that other tension bands may be included within certain embodiments of the swimsuit 10 as presently contemplated. In particular, as illustrated in FIG. 5, a central rear band 50 which extends rearward from a perineum region of the swimsuit and vertically upward along a rear centerline of the torso portion of the swimsuit. In certain embodiments, such as the first embodiment pictured in FIG. 5, the central rear tension band 48 may extend to the rear waist region 14. In other embodiments, however, it may be seen that the the central rear tension band may extend beyond the rear of the waistband region 14.

A pair of lower torso bands 52 may also be included within embodiments of the presently contemplated swimsuit 10. Each of the pair of lower torso bands 52 may extend from the perineum region 16 at least to the front of the waist region 14. In the exemplary embodiment, the front torso bands 52 may be configured in a "v" configuration and be disposed underneath a seam 28 at the torso portion, and in this fashion may also serve as a gusset for strengthening that seam. According to certain embodiments, such as the first embodiment pictured in FIG. 4, the lower torso bands 52 may extend further, for example, by traversing the waist region 14 and extending upward across a respective side of the torso portion 12, and to a rear of the torso portion 12.

A pair of rear torso bands 54 is also contemplated as being included in certain embodiments of the swimsuit 10, including the first embodiment as best shown in FIG. 5 and the second embodiment as best shown in FIG. 7. As may be seen, each of the pair of rear torso bands 54 may extend upward across one of the buttocks region of the torso portion to at least the waist region 12. According to certain embodiments, such as the first embodiment shown in FIG. 5, the rear torso bands 54 may extend further beyond the waist region 14. In other embodiments, such as the second embodiment shown in FIG. 7, it may also be seen that the rear torso bands 54 may also extend downward to the rear of the thigh portions, and may extend even to the end of the thigh potions and may be connected to a respective one of the annular leg bands 22.

An inner thigh band 56 is also contemplated as being included in various embodiments of the contemplated swimsuit 10. The inner thigh band 56 may extend upward across along an inner thigh region of one of the thigh portions 20, across the perineum region 16, and downward along the inner thigh region of the other thigh portion 18. It may be seen that in certain embodiments, the inner thigh band 56 may be disposed interior to a seam 28 in the material of the external surface 26, and according to some of those embodiments, may serve as a gusset for strengthening that seam 28.

A pair of side thigh bands 58 is also contemplated as being including in various embodiments of the presently discussed swimsuits 10. Each of the side thigh bands 58 may extend laterally rearward from the perineum region 16, upward and around a respective side of a thigh portion 20 and proceeding to the front of the torso portion 12 of the swimsuit 10, and extending at least to the waistband region 14. In certain embodiments, the side thigh bands 58 may even extend further beyond the front of the waistband region 14.

A pair of front thigh bands 60 are also contemplated as being included in various embodiments of the swimsuit 10 discussed herein. Exemplary embodiments of front thigh bands 60 are best shown by the second illustrative embodiment pictured in FIG. 6, with each of the pair of front thigh bands 60 extending upward across a front of a respective one of the thigh portions 20. According to further embodiments, each of the pair of front thigh bands 42 may additionally extend across the torso portion 12, and at least to the front of the waistband region 14. However, in other embodiments, such as the first embodiment shown in FIG. 4, the front thigh bands 60 (or other groups of tension bands according to other embodiments) may be omitted entirely.

Returning to the discussion of the reinforcement liners 36, it may be seen that the configuration of tension bands in other locations other than X pattern 34 may also define other zones for more optimized placement of reinforcement liners 36. For example, as may be seen in FIGS. 6, and 7, a pair of outer thigh reinforcement zones 62 may be defined by the placement of a respective one of each pair of rear torso bands 54, side thigh bands 58, and front thigh bands 60, with the outer thigh reinforcement zone being at least partially occupied by a reinforcement liner 36. Such partial occupation is most clearly illustrated by FIG. 6, where the upper potions of each defined outer thigh reinforcement zone 62 are not fully occupied by the reinforcement liner 34, but rather an arcuate portion is unoccupied. It may be further seen by FIGS. 6 and 7 that at least one drain region 42 may be included within this reinforcement zone, and in fact in the embodiment pictured in FIGS. 6-7, there are two drain regains at the lower portion of this reinforcement zone, one being in the front of the thigh portion and one being in the rear of the thigh portion, which may be seen to result in more optimal draining of introduced water.

Likewise, other reinforcement zones at least partially occupied by reinforcing liners 36, optionally with a drain region 42, may be included within various embodiments of presently contemplated swimsuits 10, such as a buttock reinforcement zone 64, which may be defined by a respective one of each pair of respective rear torso bands 54 and side thigh bands 58, together with the inner thigh band 56, the central rear band 50, and the extended portion of the two upper torso bands 30 joined at the rear waist region. Further, side waist reinforcement zones 66 are further contemplated as being at least partially occupied by reinforcing liners 36, optionally with a drain region 42, with each side waist reinforcement zone being 66 defined by a respective one of the rear torso bands, lower torso bands, and side thigh bands together with a respective one of the upper torso band.

Turning now to FIGS. 8-14, further third and fourth exemplary embodiment of a swimsuit 10 are illustrated, showing further variations in design of the swimsuit 10 and the configuration of the tension bands. As may be seen, in the third and fourth embodiments, which include an opening in the upper back portion, which in these illustrated embodiments are also provided with a binding material 24 at its perimeter, the upper torso bands 30, rather than further comprising waist portions that extent to a rear of the waist region of the swimsuit as in the embodiments pictured n FIGS. 1-7, instead may be seen to include a rear thigh portion which extend down to a rear of the perineum region 16 of the swimsuit. Such rear thigh portions may be seen to be vary in positioning and design in certain embodiments relative to the earlier discussed side thigh bands in the embodiment of FIGS. 1-7, but may generally be seen in other embodiments to have a similar positioning.

Likewise, it may be seen that in the embodiments illustrated in FIGS. 8-14, an independent rear waist band 68 may be included within the network of tension bands, rather (or in addition to) than the rear waist portions 32 of the upper torso bands 30, as in the embodiments shown in of FIGS. 1-7. Such rear waist band 68 be similarly positioned to the rear waist portions 32, or may vary somewhat in positioning or design. It may further be seen that in the embodiments illustrated in FIGS. 8-14, variations may exist in which the rear thigh bands 54 may proceed up beyond the waist region and along the side of the torso portion, ultimately proceeding to the underarm region 18.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the exemplary embodiments.

What is claimed is:

1. A swimsuit having at least a torso portion and two thigh portions configured to be worn over and compress against at least a portion of a torso and thighs of a swimmer, the swimsuit comprising:

an external surface;

a plurality of tension bands disposed interior to the external surface of the swimsuit, each of the one or more tension bands being configured to have a tensile elasticity along its longitudinal axis greater than a tensile elasticity of the external surface, the plurality of tension bands comprising at least two upper torso bands extending downward from a respective underarm region of the swimsuit to an opposite lateral waist region of the swimsuit, the at least two upper torso bands intersecting at a front centerline of the torso portion so as to define an X pattern; and a plurality of reinforcement liners interior to the external surface, each of the plurality of reinforcement liners being defined by at least one or more peripheral regions and at least one or more interior regions; and wherein the plurality of reinforcement liners comprises one or more X pattern reinforcement liners, the X pattern reinforcement liners at least partially occupying at least one of two lateral reinforcement zones defined by the lateral side portions of the X pattern, each of the one or more X pattern reinforcement liners being detached from the external surface at their respective one or more interior regions.

2. The swimsuit of claim 1, wherein the one or more X pattern reinforcement liners further at least partially occupy at least one of an upper reinforcement zone defined by the upper portion of the X pattern and a lower reinforcement zone defined by the lower portion of the X pattern.

3. The swimsuit of claim 1, wherein the plurality of tension bands are disposed on an interior surface of the swimsuit.

4. The swimsuit of claim 1, wherein the external surface across a rear of the torso portion, a rear of two thigh portions, and a junction therebetween is formed from a continuous, seamless external surface material.

5. The swimsuit of claim 1, wherein each of the two upper torso bands further comprise one or more of: a rear waist portion which extend to a rear waist region of the swimsuit; a rear thigh portion which extends to a rear of a perineum region of the swimsuit.

6. The swimsuit of claim 5, wherein the two upper torso bands further comprise a rear waist portion, and wherein each respective rear waist portion are joined together at the rear of a waist region.

7. The swimsuit of claim 1, wherein the plurality of tension bands further comprise at least one of the group selected from:

(a) a central rear band extending rearward from a perineum region of the swimsuit and vertically upward along a rear centerline of the torso portion;

(b) a pair of lower torso bands, each of the lower torso bands extending laterally forward and upward from a perineum region of the swimsuit to at least a waist region of the torso portion;

(c) a pair of rear torso bands, each rear torso band extending upward along the rear of a respective buttock region of the torso portion at least to a rear of the waist region of the torso portion;

(d) an inner thigh band extending upward along an inner thigh region of one thigh portion, across the perineum region, and downward along the inner thigh region of the other thigh portion;

(e) a pair of side thigh bands, each side thigh band extending laterally rearward from the perineum region, around the side of a respective thigh portion, and to the front of a respective thigh portion;

(f) a pair of front thigh bands, each front thigh band extending upward along the front of a respective one of the thigh portions; and (g) a rear waist band, the rear waist band being positioned laterally along the rear waist region of the swimsuit.

8. The swimsuit of claim 7, wherein the plurality of tension bands comprises the pair of lower torso bands, and wherein each lower torso band further extends upward around a respective lateral side of the torso portion to a rear of the torso portion.

9. The swimsuit of claim 7, wherein the plurality of tension bands comprises the pair of rear torso bands, and wherein each rear torso band further extends beyond the rear of the waist region of the torso portion.

10. The swimsuit of claim 1, wherein at least one of the reinforcement liner at least partially occupying the lateral reinforcement zone defines at least one drain region wherein a portion of the peripheral region is detached from the external surface of the swimsuit.

11. The swimsuit of claim 7, wherein the plurality of tension bands further comprises at least the pair of rear torso bands, the pair of side thigh bands, and the pair of front thigh bands, wherein each respective rear torso band, side thigh band, and front thigh band of each pair defines a respective outer thigh reinforcement zone, and wherein each outer thigh reinforcement zone is at least partially occupied by a reinforcement liner.

12. The swimsuit of claim 11, wherein each reinforcement liner at least partially occupying each of the outer thigh reinforcement zones defines at least one drain region wherein a portion of the peripheral region is detached from the external surface of the swimsuit.

13. The swimsuit of claim 7, wherein the two upper torso bands further extend to and are joined at a rear waist region of the swimsuit, and wherein the plurality of tension bands further comprises at least the pair of rear torso bands, the pair of side thigh bands, the inner thigh band, and the central rear band, wherein each respective rear torso band and side thigh band of each pair together with the inner thigh band, the central rear band and the extended portion of the two upper torso bands joined at the rear waist region of the swimsuit defines a respective buttock reinforcement zone, and wherein each buttock reinforcement zone is at least partially occupied by a reinforcement liner.

14. The swimsuit of claim 13, wherein each reinforcement liner at least partially occupying each of the buttock reinforcement zones defines at least one drain region wherein a portion of the peripheral region is detached from the external surface of the swimsuit.

15. The swimsuit of claim 7, wherein the plurality of tension bands further comprises at least the pair of rear torso bands, the pair of lower torso bands, and the pair of side thigh bands, wherein each respective rear torso band, lower torso band, and side thigh band together with a respective upper torso band defines a respective side waist reinforcement zone, and wherein each side waist reinforcement zone is at least partially occupied by a reinforcement liner.

16. The swimsuit of claim 15, wherein each reinforcement liner at least partially occupying each of the side waist reinforcement zones defines a drain region wherein a portion of the peripheral region is detached from the external surface of the swimsuit.

17. The swimsuit of claim 1, wherein each thigh portion of the swimsuit is further provided with an annular leg band.

18. The swimsuit of claim 17, wherein the annular leg bands are configured to cause the swimsuit to apply a localized compressive force to the thighs of the swimmer greater that that the compressive force applied by the external surface of the swimsuit at the thigh portion alone.

19. The swimsuit of claim 17, wherein the annular leg bands are configured to grip the thighs of the swimmer more securely than the external surface of the swimsuit at the thigh portion alone.

20. The swimsuit of claim 19, wherein the annular leg bends are configured to grip the thighs of the swimmer more securely than the external surface of the swimsuit via being formulated from a material having a lower coefficient of friction when wet than the material of the external surface.

* * * * *